US005170639A

United States Patent [19]

Datta

[11] Patent Number: 5,170,639

[45] Date of Patent: Dec. 15, 1992

[54] CASCADE REFRIGERATION SYSTEM

[76] Inventor: Chander Datta, R.R. #6, Kingston, Ontario, Canada, K7L 4V3

[21] Appl. No.: 805,856

[22] Filed: Dec. 10, 1991

[51] Int. Cl.[5] ..... F25B 7/00

[52] U.S. Cl. ..... 62/228.3; 62/335

[58] Field of Search ..... 62/335, 79, 229, 228.3

[56] References Cited

U.S. PATENT DOCUMENTS

| | | | |
|---|---|---|---|
| 2,717,765 | 9/1955 | Lawler, Jr. | 62/335 X |
| 2,796,743 | 6/1957 | McFarlan | 62/335 |
| 2,841,962 | 7/1958 | Richards | 62/335 X |
| 3,733,845 | 5/1973 | Lieberman | 62/335 |
| 4,402,189 | 9/1983 | Schaeffer | 62/335 X |
| 4,484,449 | 11/1984 | Muench | 62/335 X |
| 4,777,805 | 10/1988 | Hashizume | 62/335 X |
| 4,850,199 | 7/1989 | DiNovo et al. | 62/335 X |
| 5,105,633 | 4/1992 | Briggs | 62/335 X |

FOREIGN PATENT DOCUMENTS

| | | | |
|---|---|---|---|
| 1021887 | 6/1983 | U.S.S.R. | 62/335 |

*Primary Examiner*—William E. Tapolcai

*Attorney, Agent, or Firm*—Daniel E. Kramer

[57] ABSTRACT

A cascade vapor compression refrigeration system having a high stage and a low stage, each stage having a compressor, evpaorator, condenser and expansion device. The high-stage evaporator is in heat transfer relationship with the low-stage condenser. There is further provided an air-to-refrigerant heat exchange element, including means for moving air over the element. The heat exchange element is connected in the discharge line of the low-stage system and is positioned to be subject to a fluctuating outoor ambient temperature. Control means are provided which are responsive to some characteristic related to outdoor temperature whereby high-stage compressor operation is permitted when the outdoor ambient is below a preset temperature and high-stage compressor operation is prevented when the outdoor ambient is above a preset temperature.

7 Claims, 2 Drawing Sheets

CASCADE REFRIGERATION SYSTEM

FIELD OF THE INVENTION

The present invention relates to vapor compression type refrigerating systems having an evaporator and a condenser employing a volatile fluid as refrigerant. The invention further relates to such refrigeration systems for producing very low temperatures. The invention further relates to a combination of two or more refrigeration systems arranged so the refrigeration produced at the evaporator of one system provides cooling for the condenser of another system. The invention further relates to improvements in such combined systems in which the cooling effect provided by the first system is temporarily replaced by the cooling effect of cold outside air when conditions for such replacement are present. The invention further relates to means for sensing conditions when such replacement can become effective and for causing such replacement to take effect, and for stopping such replacement when conditions are ineffective for that purpose.

BACKGROUND OF THE INVENTION

Refrigeration systems are most commonly employed for the purpose of cooling habitable environments for human comfort, a function called air-conditioning, and for cooling fluids or products to lower temperatures for commercial processes employed in manufacturing and in the processing and preservation of foods. All refrigeration systems operate between a lower temperature at which a heat collector must be maintained to produce the cooling effect desired, and a higher temperature at which a heat dissipator must be able to reject the sum of the heat picked up at the heat collector and the energy required to be put into the system to move the heat picked up from the lower to the higher temperature.

In vapor compression refrigeration practice the heat collector is called an evaporator because refrigerant liquid is evaporated to a vapor in it. This evaporation provides a cooling effect to material, fluid or solid, which is arranged in heat transfer relation to the evaporator. The heat dissipator is called a condenser because in it refrigerant vapor produced by the evaporator is condensed to a liquid for recycling back to the evaporator. The condensation within the condenser is achieved by arranging for a coolant to be placed or passed in heat exchange relation to the condenser. A motor driven compressor removes the vapor from the evaporator at a lower pressure and lower temperature and pumps it to the condenser at higher pressure where its heat can be dissipated to the coolant at a higher temperature.

In 1824 a French engineer, Nicholas Leonard Sadi Carnot, first published, in a paper titled "Reflections on the Motive Power of Fire, and on Machines Fitted to Develop that Power", a theory which developed the principle that a heat engine, (a vapor compression refrigeration system being one type of a heat engine), must have both a heat source and a heat sink. He further demonstrated that the efficiency of a heat engine is dependent on the temperature difference between the heat source and the heat sink. In refrigeration terms this means that for a condensing coolant of a given temperature the efficiency and capacity of a given refrigerating machine will decrease as the temperature desired at the evaporator decreases. Conversely, the efficiency of the refrigerating machine will increase as the temperature of the condensing coolant decreases.

In an effort to minimize the effect of Carnot's thermodynamic principle, and to improved the mechanical performance of mechanical gas compressors both of which are severely degraded with increasing pressure difference, various stratagems have been devised. Among these is the system where refrigerating compressors are placed in series so that each compressor has to pump over a smaller pressure difference than a single compressor performing the same function. This series compression is called a compound compression system. Another is the so-called cascade system, on which the present invention is an improvement. Cascade systems employ two or more separate vapor compression type refrigeration systems in series. The systems may each have the same type volatile refrigerant or may each have different types. In cascade systems a first system directly cools the fluid or product to be cooled. This first system, generally known as a low-temperature stage or 'low-stage' system, has its heat rejecting element or condenser cooled by the refrigerating effect of a second refrigerating system which is commonly called the high temperature stage or high stage. A heat transfer liquid circulated by a pump between the cooling effect of the high-stage and the heat dissipating effect of the lowstage achieves the necessary heat transfer between the high-stage and the low-stage.

The present invention improves on the known cascade systems by providing an air-cooled heat-exchanger in the discharge line between the low-stage compressor and the low-stage condenser. The heat exchanger is positioned to be subject to an alternating cooler and warmer ambient. When the heat exchanger is subject to the warmer ambient, the usual high stage system must be operated to provide cooling for the low-stage condenser. However, when a cooler ambient is present around the heat exchanger, the high stage system is shut off and the required cooling for the low stage condenser provided by the air-cooled heat exchanger.

Control means for establishing the desirable operating modes of the various components, under various operating conditions, are described.

In another embodiment of the present invention, a refrigeration system is equipped with an evaporator for cooling a first fluid stream, such as air or liquid. A secondary heat exchange element conveying a second fluid to be cooled is positioned in heat transfer relation to the first fluid stream enroute to the evaporator. The second fluid, cooled by the secondary heat exchange element, is employed in either of two different ways: In one embodiment of the present invention the second fluid is employed to provide cooling to a process or system external to the parent system in whose fluid stream the second fluid is cooled. In that embodiment the refrigeration system having and cooling the secondary heat exchange element is the high stage of a cascade refrigeration system and the second fluid is routed to the low-stage condenser to provide cooling for it.

In another embodiment of the present invention the refrigeration system having and cooling the secondary heat exchange element is the low-stage of a cascade refrigeration system and the second fluid is the liquid refrigerant flowing from the low-stage condenser to the low-stage expansion device.

SUMMARY OF THE INVENTION

Briefly stated, the present invention comprises a cascade vapor compression type refrigeration system.

The system comprises a low temperature stage which includes a first refrigeration circuit employing a first volatile refrigerant. The first refrigeration circuit comprises an expansion device, evaporator means for evaporating the first volatile refrigerant at a first evaporating temperature and a compressor having a discharge connection. Condenser means are provided for receiving the first volatile refrigerant from the compressor and condensing it to a liquid at a first condensing temperature. Discharge conduit means are provided for connecting the compressor discharge connection with the condenser means.

The system further comprises a high temperature stage, including a second refrigeration circuit, employing a second volatile refrigerant. The second circuit comprises an expansion device, compressor and condenser means for receiving the second volatile refrigerant from the compressor and condensing it to a second liquid. Evaporator means are provided for receiving second liquid refrigerant and evaporating it at an evaporating temperature.

The system further provides that the evaporator means of the high temperature stage is in direct heat exchange relation with the condenser means of the low temperature stage, thereby allowing the condensing temperature of the low temperature stage to be related to the evaporating temperature of the high temperature stage.

There is further provided a secondary air-cooled condenser connected in the discharge conduit of the low-stage and positioned to be alternately subject to high and low air temperatures. And means are provided to turn off the high stage compressor when the air temperature to which the secondary condenser is subject is low and to turn on the high stage compressor when the air temperature to which the secondary heat exchanger is subject is high.

BRIEF DESCRIPTION OF THE DRAWINGS

The foregoing summary, as well as the following description of the preferred embodiments of the invention will be better understood when read in conjunction with the appended drawings. For the purpose of illustrating the invention, there is shown in the drawings, embodiments which are presently preferred, it being understood, however, that the invention is not limited to the specific instrumentalities or to the specific arrangements of elements disclosed. In the drawings.

DETAILED DESCRIPTION OF THE INVENTION

Figure 1:
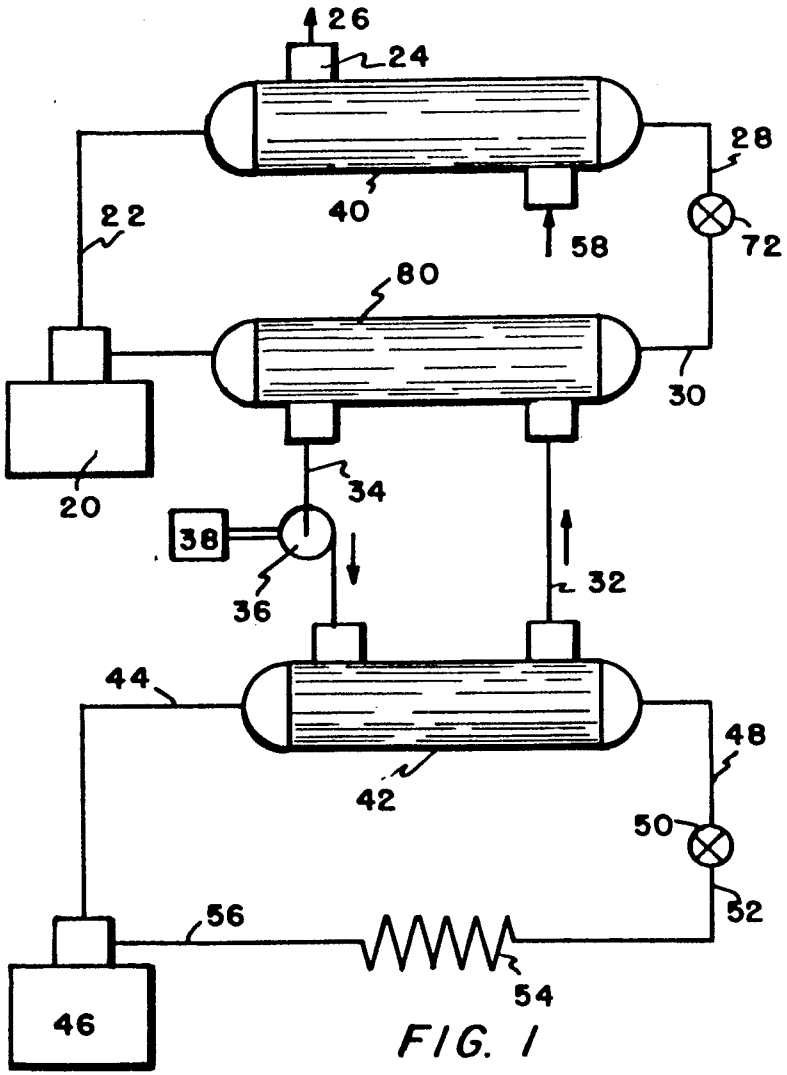
FIG. 1 PRIOR ART
FIG. 1 is a schematic representation of a prior art cascade refrigeration system.

Referring now to the drawings, wherein like references are used to indicate like elements, there is shown in FIG. 1 a cascade refrigerating system having a low-stage system employing low-stage compressor 46 and a first refrigerant; and a high-stage system employing high-stage compressor 20 and a second refrigerant. The low-stage compressor 46 withdraws first refrigerant vapor from low-stage evaporator 54. Low stage evaporator 54 is of the air-cooling type employing motor driven fans, shown by example in FIG. 4, move the air to be cooled over the heat transfer surfaces of the evaporator 54. Compressor 46 compresses the refrigerant and discharges it to condenser 42 via discharge line 44. Condenser 42 is of the shell and coil type though any type of heat exchanger suitable for exchanging heat between a condensing refrigerant and a pump circulated coolant is satisfactory. The first refrigerant vapor, having been condensed to a first refrigerant liquid in condenser 42, flows to expansion valve 50 where its pressure, and therefor its temperature, is reduced to a level suitable for performing the low temperature refrigeration for which the system was designed. Typical evaporating temperatures for evaporators in low-stage cascade systems range from −20F (−28C) to −110F (−79C), though operating temperatures outside that range are not uncommon. Conforming to the usage established in this specification of designation the low-stage system as the 'first' system, the 'first' refrigerant employed in the low-stage system is refrigerant 22 (R-22), a designation for a chemical compound monochloro-difluoro-methane. The numerical designation for most commonly used refrigerants has been standardized by the American Society of Heating, Refrigerating and Air conditioning Engineers (ASHRAE) in its Standard 34, titled "Number Designation and Safety Classification of Refrigerants". Refrigerant designations used herein will conform to ASHRAE Standard 34. Other refrigerants commonly employed as low-stage refrigerants are R-12, R-502, R-170, R-290 and R-717.

In order to achieve the efficiencies which the designer expects from the low stage system it must have a relatively low condensing temperature, typically 0F to 35F, though in many cases, condensing temperatures up to 45F are tolerable. However, if ordinary coolants, available during summer or warm periods, were employed for removing heat from condenser 42, the condensing temperatures encountered by the low stage compressor 46 would be in the region of 75F to 120F. Such ordinary coolants are water alone, air alone and water evaporated in an airstream. Therefore, to achieve the desired condensing temperatures for the low-stage system, a high-stage refrigeration system employing compressor 20 is utilized to mechanically cool the condenser 42 of the low-stage system, thereby producing condensing temperatures in the desired range. Compressor 20 cools liquid chilling evaporator 80 by withdrawing vapor of the second volatile refrigerant from it. The second volatile refrigerant may be the same as the first or low-stage refrigerant or it may be a refrigerant which has a higher boiling point. In this case the second refrigerant is R-12 whose chemical name is dichlorodifluoro-methane. The compressor 20 discharges the compressed second refrigerant through discharge line 22 to the condenser 40. The hot compressed second refrigerant is condensed to a liquid in condenser 40 by heat exchange with an ordinary coolant such as air alone, water alone or water evaporated in an airstream. Though a water-cooled design of condenser 40 is shown in FIG. 1, the use of any of the ordinary coolants is contemplated. Water from a well, city main, river or from a recirculating cooling system such a cooling tower or pond can be employed. During warm or summer conditions, condensing temperatures in the range of 75F to 120F are expected. Liquid second refrigerant is conveyed to expansion device 72 from condenser 40 via conduit 28. In the industry, conduit 28 is commonly called a liquid line. Expansion device 72 meters the second refrigerant liquid into evaporator 80, thereby lowering its pressure and temperature to a design value, which typically is in the region of 0F to 40F. In the present case, with an evaporating temperature of 30F, a heat transfer liquid, such as ethylene glycol-water mixture, leaves the high stage evaporator 80 through outlet conduit 34 at a temperature of 35F. The heat transfer liquid is circulated through the coolant side of low-stage condenser 42, thereby generating conditions which cause condensing in the low-stage condenser 42 to take place at 40F. The warmed heat transfer liquid, having performed its heat removal function, then returns to high-stage evaporator 80 for recooling and recycling to the low-stage condenser. A pump 36 circulates and recirculates the heat transfer liquid between the high-stage evaporator 80 and the low-stage condenser 42.

Figure 2:
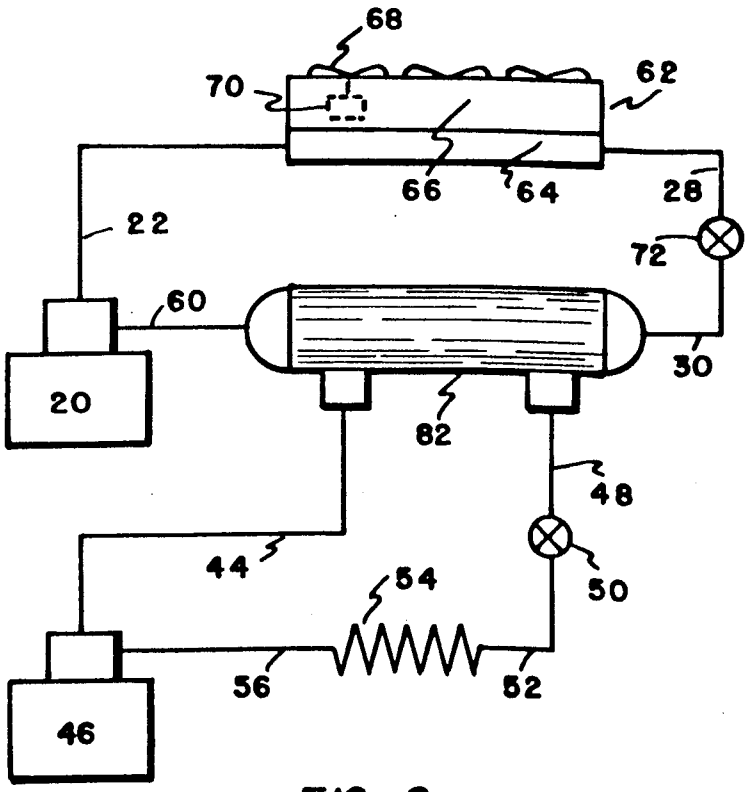
FIG. 2 is a schematic representation of a cascade refrigeration system of the present invention.

In FIG. 2 of the present invention, the fluid loop comprising pump 36 and conduits 32 and 34 are eliminated. In FIG. 2 the evaporating portion of high-stage evaporator 80 of FIG. 1 and the condensing portion of condenser 42 of FIG. 1 are combined into a new element 82 in which the evaporating function of the high-stage and the condensing function of the low-stage are combined in one envelope and are in heat-transfer relationship. Therefore, in further description of the operation of the systems involving the use of element 82, it may be referred to in some contexts as 'high-stage evaporator 82' and in other contexts as 'low-stage condenser 82'. In FIG. 2 a high-stage condenser 62 is shown which employs air as the ordinary coolant. Ambient air is drawn through a finned heat transfer coil 64 which is mounted under a fan section 66 thereby abstracting heat from the second refrigerant vapor causing it to condense. Fan section 66 has mounted within it one or more fans 68, each fan driven by a motor 70. These fans draw outside air, at a temperature which varies with the time of day and the season, across heat transfer element 64, within which condensation of the second refrigerant takes place. Outdoor air temperatures may range from −25F to 110F or higher. Typically, high-stage condensing temperatures are 15F to 25F higher than the air temperatures. The number of degrees that the condensing temperature is higher than the air temperature is called the condensing temperature difference or condensing TD and is determined by the system designer through selection of the size and capacity of the air-cooled condenser. The second refrigerant liquid resulting from condensation of the second refrigerant vapor in condenser 62, is conveyed to expansion device 72 via conduit 28. The expansion device 72 feeds the second refrigerant liquid to the evaporator side of heat exchanger 82 at reduced temperature and pressure where it evaporates, thereby cooling and condensing the first refrigerant vapor pumped to the condensing side of heat exchanger 82 by low-stage compressor 46. With the exception of the means utilized to remove the heat from its low-stage condenser, the low-stage system displayed in FIG. 2 operates exactly the same as, and performs the same function in the same way as the low-stage system described in connection with FIG. 1.

In the system of FIG. 2 the high-stage system must operate so long as refrigeration by the low-stage system is desired. In large cascade systems the controls are so arranged that when cooling is required by the low-stage system, only the high-stage system is allowed to operate until the temperature of the coolant cooled by the high-stage and employed as condensing coolant for the low-stage, reaches its design temperature. At that time, the low-stage system is allowed to start, now being assured of adequate cooling for its condenser.

Figure 3:
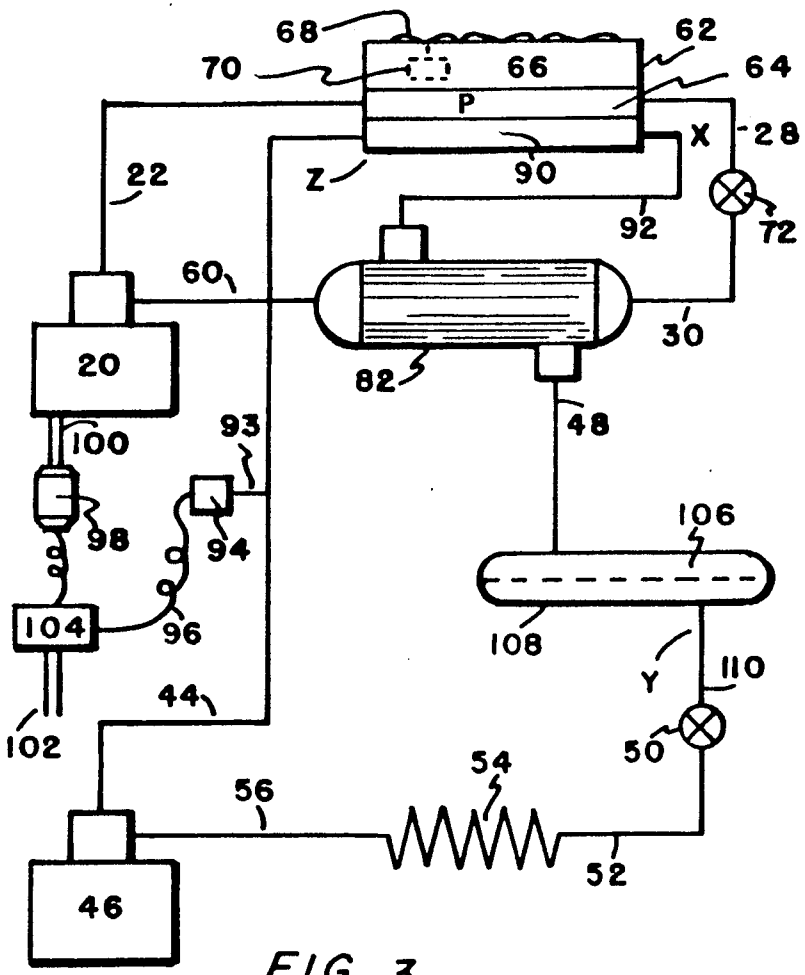
FIG. 3 is an improved version of the system of FIG. 2 having a secondary outdoor low-stage condenser.

The embodiment of the present invention shown in FIG. 3 employs substantially the same components as the systems shown in FIG. 2 with the following exceptions:

1. An air to refrigerant heat exchange element 90 has been positioned in the entering airstream of high-stage air-cooled condenser 62. This heat exchange element 90 has been connected in the discharge line 44 of the low-stage system between the discharge of the low-stage compressor 46 and the inlet of the low-stage condenser 82.

2. A control 94 has been provided, sensing the pressure in the low-stage discharge line 44, to allow and prevent operation of the motor 98 of high-stage compressor 20.

3. An optional low-stage liquid receiver 106 has been provided between the liquid outlet of low-stage condenser 82 and low-stage expansion device 50.

The cascade system of FIG. 3 is an embodiment of the present invention. It is an object of the system of FIG. 3 to allow the high stage compressor to be automatically shut off whenever the outdoor temperature adjacent high-stage air-cooled condenser 62 is sufficiently cool. The criterion for adequate coolness is that it will provide low-stage condensing temperature within the design condensing temperature range. Typically, the air temperature must be 8F to 15F lower than the desired low-stage condensing temperature.

In the system of FIG. 3 low-stage compressor 46 withdraws first refrigerant vapor from low-stage evaporator 54 and compresses the vapor and discharges it at higher pressure into discharge line 44. The compressed vapor is conveyed to low stage condenser 82 via discharge line 44, heat exchange element 90 and conduit 92. Within the condenser 82, the first refrigerant vapor is condensed to a liquid. From low-stage condenser 82 the condensed liquid flows to optional receiver 108. Receivers are sometimes employed in larger systems to provide for fluctuation in the operating charges of evaporators and or condensers. The pool 106 of first refrigerant liquid, stored in receiver 108, is delivered as required to expansion device 50 which meters the liquid refrigerant into low-stage evaporator 54 at reduced pressure and temperature. There it is evaporated to a vapor in the process of cooling whatever solid, liquid or gaseous product which the system has been designed to cool.

It is an object of the present invention to save power by preventing the high-stage system from running whenever the ambient temperature to which heat exchange element 90 is exposed is sufficiently low to assure that with heat exchange element 90 operating as the low-stage condenser, instead of low-stage condenser 82, the low-stage condensing temperature will be within the required range. To achieve this object a control 94 is provided for the purpose of sensing some characteristic which is responsive to outdoor temperature on which the allowing/preventing function of the control can be based. In FIG. 3 control 94 is shown connected into the low-stage discharge line 44 for the purpose of measuring the pressure therein. In another embodiment of the present invention the control 94 is subject to the condensing pressure F of the high stage system. It is to be clearly understood that the pressures at any point in any conduit or apparatus between the discharge of compressor 46 and the expansion device 50 are closely related and that for the purposes of this disclosure, a pressure measured or monitored at one such point is equivalent to the pressure measured or monitored at another. Pressures within the above described portion of any refrigeration system are subject to the high pressure of the compressor discharge. These pressures are frequently described as being 'highside' pressures and will be periodically referred to as such in this specification.

Though not shown in the drawings, there is provided an overall operating control for the cascade system. The operating control may be manual or responsive to time or to the temperature of some product or environment. For example, the operating control may start the cascade system each day at 9:00 AM with the exception of Saturday and Sunday. Alternatively, the operating control may start the cascade system when the temperature in a chamber refrigerated by the cascade system rises above a preset temperature. The operating control starts both the high and the low-stage systems either together or in a predetermined sequence. While control 94 acts to allow or prevent the operation of high-stage compressor 20, it is only effective when the operating control calls for cooling and the high-stage system would otherwise be operative.

The discharge pressure of the low-stage system will be responsive to the high-stage condensing pressure and therefore to the outdoor ambient temperature. As the outdoor ambient drops, the high-stage discharge pressure drops and thereby increases the capacity of the high-stage system. This increase in high-stage cooling capacity acts to reduce the condensing temperature and therefore the pressure in the high-side of the low-stage system. When the pressure in the highside of the low-stage reaches a preset value, requiring an inference that the outdoor ambient affecting the heat exchange element 90 has dropped below a predetermined value, control 94 acts to prevent operation of high-stage compressor 20. On termination of operation of high-stage compressor 20, heat removal from and condensation of first refrigerant vapor in low-stage condenser 82 stops and condensation of first refrigerant vapor discharged by low-stage compressor 46 takes place only in heat exchange element 90. Heat exchange element 90, therefore, now becomes the new low-stage condenser, during that time that the high-stage compressor 20 is prevented from operating by control 94.

In like manner a temperature sensing control is positioned at z to respond to the temperature of the air entering heat exchange element 90. Similar temperature sensing controls x and y are positioned to respond to the temperature of the conduit 92 which conveys flow from heat exchange element 90 to low-stage condenser 82 and the temperature of the liquid line between low-stage condenser 82 and expansion device 50. The activity of any of these controls is effective to allow or prevent the operation of the high-stage compressor 90 when the outdoor ambient is above or below a preset temperature, as described above in embodiments of the present invention employing these controls.

Figure 4:
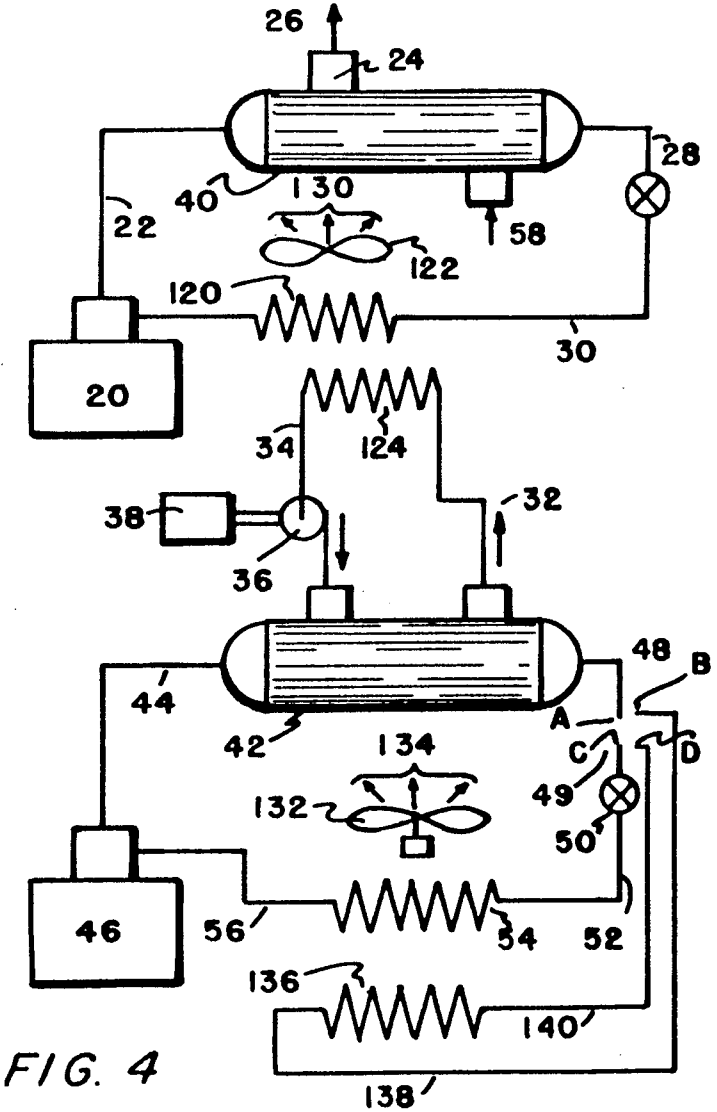
FIG. 4 is a further improved cascade refrigeration system having both high-stage and low-stage evaporators equipped with secondary heat exchange elements.

FIG. 4 is a schematic piping diagram of a cascade system employing improved evaporators for the purpose of improving the performance, reliability and efficiency of cascade systems to which they are applied.

It has been found that the capacity of fluid cooling evaporators and the capacity of the vapor compression refrigerating systems of which they are a part, are improved by using the cooling effect available in the fluid entering the evaporator to be cooled to perform some thermodynamically useful function within or outside the system itself. The use of the cooling capability of the fluid entering the evaporator has the effect of raising the temperature of the fluid entering the evaporators. This increases the temperature difference between the fluid and the evaporating refrigerant, thereby increasing the evaporator capacity. The operation of the evaporator at increased capacity causes the evaporating temperature inside the evaporator to rise. This raises the suction pressure in the system which in turn increases the compressor and the system capacity.

Referring now to the cascade system embodiment of the present invention shown schematically in FIG. 4, there is shown a high-stage air-cooling evaporator coil 120 having associated therewith evaporator fan 122. Fan 122 causes airstream 130 to be drawn over the evaporator coil 120 and also over liquid cooling heat exchanger 124 which is positioned in the airstream 130 as it enters the evaporator coil 120. The high-stage system acts to cool evaporator coil 120 by the action of compressor 20 which withdraws second refrigerant vapor from evaporator 120, compresses the vapor and discharges the vapor to condenser 40. Though condenser 40 is illustrated as a liquid cooled condenser, in other embodiments of the present invention, an air-cooled condenser, in one case including the heat exchange element 90 of FIG. 3, is substituted. Liquid second refrigerant flows from condenser 40 to expansion device 72 where it is fed at reduced pressure and temperature to evaporator coil 120, discussed above, which performs its air stream cooling function by withdrawing heat from and thereby cooling the air stream, the second liquid being evaporated to vapor for recycling through the high-stage system by compressor 20.

Although evaporator coil 120 is shown in an air-cooling construction, the functions of the present invention are also performed in an embodiment employing the evaporator 80 of FIG. 1 together with a supplementary heat exchanger positioned in fluid inlet conduit 32.

Referring now to the low-stage system of FIG. 4, evaporator 54 receives first refrigerant liquid from expansion device 50 at reduced temperature and pressure and evaporates the cold liquid in heat transfer relation to the air stream 134, thereby cooling the air stream. The first refrigerant vapor emitted by the evaporator 54 into suction line 56 is evacuated by compressor 46 and discharged at higher pressure through discharge line 44 to low-stage condenser 42. The coolant for low-stage condenser 42 is provided by the fluid circulated by pump 36 through heat exchange element 124, which element is associated with and cooled by the fluid stream entering high-stage evaporator 120, as explained above. The cooled fluid removes the heat of condensation from the first refrigerant in low-stage condenser 42 and returns to heat exchange element 132 via conduit 32 for re-cooling.

Liquid first refrigerant resulting from condensation of vapor in low-stage condenser 42 is delivered to expansion device 50 by liquid line conduit 48. An auxiliary heat exchange element 136 is provided at the fluid inlet of low-stage evaporator 54. In another embodiment of the present invention, liquid line 48 is broken at points A–C and conduits 138, 140 are connected thereto. Through this reconnection, warm, possibly bubbling, liquid from low-stage condenser 42 is subcooled, thereby warming the fluid stream entering low-stage evaporator 54, thereby improving its capacity and the capacity and efficiency of the low-stage system.

From the foregoing description, it can be seen that the present invention comprises an improved cascade vapor compression type refrigeration system. It should be appreciated by those skilled in the art that changes could be made to the above described embodiments without departing from the broad inventive concepts taught herein. It is understood, therefore, that this invention is not limited to the particular embodiments discussed but is intended to cover all modifications and equivalents thereof which are within the scope and spirit of the invention as defined by the appended claims.

I claim:

1. A cascade compression type refrigeration system having a low temperature stage, said low temperature stage including a first refrigeration circuit employing a first volatile refrigerant, said first refrigeration circuit comprising an expansion device, evaporator means for evaporating the first volatile refrigerant at a first evaporating temperature, a compressor including a discharge connection, condenser means for receiving the first volatile refrigerant from the compressor and condensing it to a first liquid at a condensing temperature and discharge conduit means connecting the compressor discharge connection with the condenser means and a high temperature stage said high temperature stage including a second refrigeration circuit employing a second volatile refrigerant, said second circuit comprising an expansion device, compressor, condenser means, further providing that the condenser means for the high temperature stage includes: means for generating an airstream, a first heat transfer means subject to the airstream for removing the heat of condensation, the first heat transfer means having an air inlet side and an air outlet side, the said air-cooled condenser means further including second heat transfer means positioned in the condenser airstream, said second heat transfer means including a refrigerant inlet and a refrigerant outlet, and further providing that the second heat transfer means is connected in the discharge conduit means of the low temperature stage system such that the refrigerant inlet of the second heat transfer means is connected to the low temperature stage compressor discharge and the refrigerant outlet of the second heat transfer means is connected to the low temperature stage condenser means for receiving the second volatile refrigerant from the compressor and condensing it to a second liquid, and evaporator means for receiving liquid refrigerant and evaporating it at an evaporating temperature, and further providing that the evaporator means of the high temperature stage is in direct heat exchange relation with the condenser means of the low temperature stage, thereby allowing the condensing temperature of the low temperature stage to be related to the evaporating temperature of the high temperature stage, and further providing means responsive to the temperature of the airstream for starting and stopping the high stage compressor, whereby the high stage compressor is caused to operate when the airstream temperature is higher and the high-stage compressor is caused to stop when the airstream temperature is lower.

2. A cascade compression type refrigerating system as recited in claim 1 where the means responsive to the temperature of the airstream is a thermostat subject to the airstream.

3. A cascade compression type refrigeration system as recited in claim 1 where the means responsive to the temperature of the airstream is a pressure sensing device subject to the condensing pressure of the low-stage system.

4. A cascade compression type refrigeration system as recited in claim 1 where the means responsive to the temperature of the airstream is a pressure sensing device subject to the condensing pressure of the high-stage system.

5. A cascade compression type refrigeration system as recited in claim 1 where the means responsive to the temperature of the airstream is a temperature sensing device subject to the temperature of the first liquid refrigerant.

6. A cascade compression type refrigeration system as recited in claim 1 where the means responsive to the temperature of the airstream is a temperature sensing device subject to the temperature of the refrigerant at a point between the refrigerant inlet of the second heat transfer means and the low temperature stage condenser means.

7. A cascade compression type refrigeration system having a low temperature stage, said low temperature stage including a first refrigeration circuit employing a first volatile refrigerant; said first refrigeration circuit comprising an expansion device, evaporator means for evaporating the first volatile refrigerant at a first evaporating temperature, a compressor including a discharge connection, condenser means for receiving the first volatile refrigerant from the compressor and condensing it to a first liquid at a condensing temperature and discharge conduit means connecting the compressor discharge connection with the condenser means and a high temperature stage said high temperature stage including a second refrigeration circuit employing a second volatile refrigerant; said second circuit comprising an expansion device, compressor, condenser means for receiving the second volatile refrigerant from the compressor and condensing it to a second liquid, and further providing that the condenser means for the high temperature stage includes: means for generating an airstream, a first heat transfer means subject to the airstream for removing the heat of condensation, the first heat transfer means having an air inlet side and an air outlet side, the said air-cooled condenser means further including second heat transfer means positioned in the condenser airstream on the air inlet side of the first heat transfer means, said second heat transfer means including a refrigerant inlet and a refrigerant outlet, and further providing that the second heat transfer means is connected in the discharge conduit means of the low temperature stage system such that the refrigeration inlet of the second heat transfer means is connected to the low temperature stage compressor discharge and the refrigerant outlet of the second heat transfer means is connected to the low temperature stage condenser means, and evaporator means for receiving liquid refrigerant and evaporating it at an evaporating temperature, and further providing that the evaporator means of the high temperature stage is in direct heat exchange relation with the condenser means of the low temperature stage, thereby allowing the condensing temperature of the low temperature stage to be related to the evaporating temperature of the high temperature stage.

* * * * *